US006955609B1

(12) United States Patent
Hiltner, Jr. et al.

(10) Patent No.: US 6,955,609 B1
(45) Date of Patent: Oct. 18, 2005

(54) GOLF CLUB AND GOLF PIN STAND

(76) Inventors: Harry F. Hiltner, Jr., 1605 Kiley Ct., Lady Lake, FL (US) 32159; Harry J. Hiltner, 604 Mcdevitt Dr., Gallaway Turnpike, NJ (US) 08201

( * ) Notice: Subject to any disclaimer, the term of this patent is extended or adjusted under 35 U.S.C. 154(b) by 0 days.

(21) Appl. No.: 10/903,616

(22) Filed: Aug. 2, 2004

(51) Int. Cl.[7] ..... A63B 57/00
(52) U.S. Cl. ..... 473/176; 116/173; 248/166
(58) Field of Search ..... 473/282, 131, 473/173–174, 177–178, 176, 179; 116/173; 248/541, 525, 528, 534, 136, 538–540, 150, 248/435, 163.2, 165, 166, 176.1, 156, 439, 248/163.1, 168, 170

(56) References Cited

U.S. PATENT DOCUMENTS

| | | | | |
|---|---|---|---|---|
| 5,127,530 | A | 7/1992 | Ortuno | 211/70.2 |
| 5,441,267 | A | 8/1995 | Alder | 273/177 |
| 5,590,865 | A * | 1/1997 | Odom, Jr. | 248/524 |
| 5,884,881 | A | 3/1999 | Band et al. | 248/166 |
| 6,029,599 | A | 2/2000 | Hiltner, Jr. | 116/173 |
| 6,179,256 | B1 | 1/2001 | Utterback | 248/166 |
| 6,244,557 | B1 * | 6/2001 | Maze | 248/541 |
| 6,308,840 | B1 | 10/2001 | Mulholland et al. | 211/70.2 |
| 6,346,051 | B1 | 2/2002 | Otsubo | 473/282 |
| 2003/0102414 | A1 | 6/2003 | Smart | 248/170 |

* cited by examiner

*Primary Examiner*—Stephen Blau
(74) *Attorney, Agent, or Firm*—Richard C. Litman

(57) ABSTRACT

A golf club and golf pin stand having a main body support bracket and a pair of leg members which, when attached to a golf pin, supports the golf pin above the ground in a tripod configuration. The main body support bracket is adapted to connect to the shaft of the golf pin. The leg members are pivotally attached to the main body support bracket and move freely relative to the main body support bracket between a retracted position when the golf pin is in a vertical position and an extended position when the golf pin is in a horizontal position.

4 Claims, 4 Drawing Sheets

GOLF CLUB AND GOLF PIN STAND

BACKGROUND OF THE INVENTION

1. Field of the Invention

The present invention relates to a golf club and a golf pin stand. More particularly, the invention relates to a device that keeps a golf pin and golf clubs from resting on the ground.

2. Description of the Related Art

Golfing is one of America's favorite pastimes. For decades, golfers have taken on all kinds of golf courses and have used a variety of devices to hold and prop up golf clubs and golf pins in addition to holding golf accessories. Some of these ingenious devices are reflected in the related art.

U.S. Pat. Application Publication No. 2003/0102414 by Smart published on Jun. 5, 2003, outlines the use of a collapsible support that includes extendable and retractable arms and legs for generating an uncollapsed and collapsed state. In the uncollapsed state, the support can be placed on most types of surfaces in an upright position to support a golf club or other items by leaning the item against arms or hanging the item from the arms. In the collapsed state, the arms and legs are substantially parallel and adjacent to the support's body and is thus easily transported or stored.

U.S. Pat. No. 5,127,530 issued to Ortuno on Jul. 7, 1992, outlines the use of a golf club stand characterized by a unitary frame having leg and receptacle portions. The lower end of the leg portion is inserted into the ground and the receptacle portion is spaced above the ground to support the grips of a plurality of golf clubs. The stand is lightweight and used by a golfer to support a number of golf clubs when the golfer is separated from his golf bag.

U.S. Pat. No. 5,441,267 issued to Alder on Aug. 15, 1995, outlines the use of a portable golf target stand having a base member, with the base member including pivotally mounted legs, with the legs arranged in a canted orientation relative to a top wall of the base member, such as the legs are arranged for an interfolding configuration to orient the leg members in a parallel relationship when interfolded.

U.S. Pat. No. 5,884,881 issued to Band et al. on Mar. 23, 1999, outlines the use of a leaning support structure that is lightweight, expandable by a single hand and has a sturdy base without the need for insertion into the ground. The leaning support structure includes first and second elongated support members offset from each other, each support member having upper and lower ends and a predetermined connecting point.

U.S. Pat. No. 6,029,599 issued to Hiltner, Jr. on Feb. 29, 2000, outlines the use of a golf pin stand device with a connector and a pair of leg members which, when attached to a golf pin, supports a golf pin above ground in a tripod configuration. The connector is adapted to connect to the shaft of a golf pin. The leg members are pivotally attached to the connector between a retracted position when the pin is in a vertical position and an extended position when the pin is in a horizontal position. Golf clubs can also be propped up against the golf pin stand device as well.

U.S. Pat. No. 6,179,256 issued to Utterback on Jan. 30, 2001, outlines the use of a golf club carrier having opposing sides supporting clubs horizontally on clips, that has a first condition resting on the ground with its legs spread and only the feet of the unit contacting the ground, and a second horizontally-collapsed condition, which is assumed as soon as the carrier is lifted from the ground.

U.S. Pat. No. 6,308,840 issued to Mulholland et al. on Oct. 30, 2001, outlines the use of a golf club holder that suspends golf clubs beneath an umbrella to keep the grips dry during any rain. The holder has a head with clip devices for attaching to an umbrella shank and for attaching the shafts of the clubs upside down to the holder.

U.S. Pat. No. 6,346,051 issued to Otsubo on Feb. 12, 2002, outlines the use of a golf club stand that is a single rod member, which includes a point at the lower end of the rod with a leg extending up from the point with a 180° bend. There is an arm depending from the bend and a first lateral member extending from the depending arm. There is also a loop at the end of the first lateral member and a second lateral member extending from the loop with an upright arm extending from the second lateral member and a coil at the end of the upright arm.

Although each of these devices are novel and useful, what is needed is a device that can prop up and hold a golf pin and golf clubs in an upright position. The device outlined in U.S. Pat. No. 6,029,599 by Hiltner, Jr. is such a device but is heavy and can be awkward to use. Perhaps a similar device that is lighter and easier to use can be developed to better serve golfers addressing the problem of securing golf clubs and golf pins in upright positions to prevent them from getting wet or dirty or from having a golfer bend over to pick up a golf club or golf pin off of the ground.

None of the above inventions and patents, taken either singly or in combination, is seen to describe the instant invention as claimed. Thus a golf pin and golf club stand solving the aforementioned problems is desired.

SUMMARY OF THE INVENTION

The invention is a golf club and golf pin stand having a main body support bracket and a pair of leg members which, when attached to a golf pin, supports the golf pin above the ground in a tripod configuration. The main body support bracket is adapted to connect to the shaft of the golf pin. The leg members are pivotally attached to the main body support bracket and move freely relative to the main body support bracket between a retracted position when the golf pin is in a vertical position and an extended position when the golf pin is in a horizontal position.

Accordingly, it is a principal object of the invention to temporarily prop up golf clubs and a golf pin in an upright position to prevent them from getting wet from being placed onto a wet or dew-soaked green.

It is another object of the invention to temporarily prop up golf clubs and a golf pin in an upright position so a user does not have to bend over to pick up a golf club or golf pin.

It is a further object of the invention to prevent damage to a green caused by golf clubs and golf pins being dropped on the green.

Still another object of the invention is to prevent a golfer from leaving his golf clubs behind when moving to another hole or green.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1A:
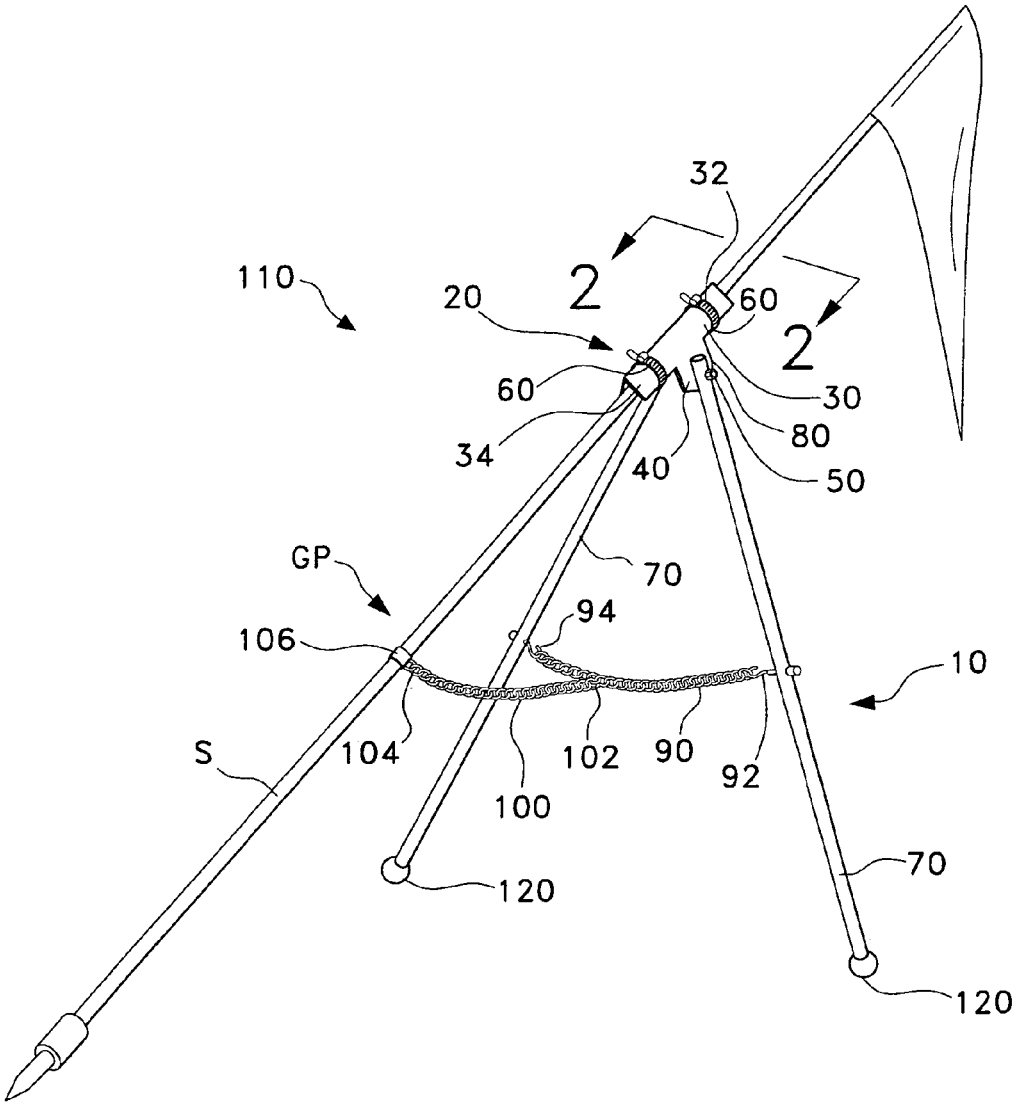
FIG. 1A and FIG. 1B are environmental, perspective views of a golf club and golf pin stand according to the present invention.
Figure 1B:
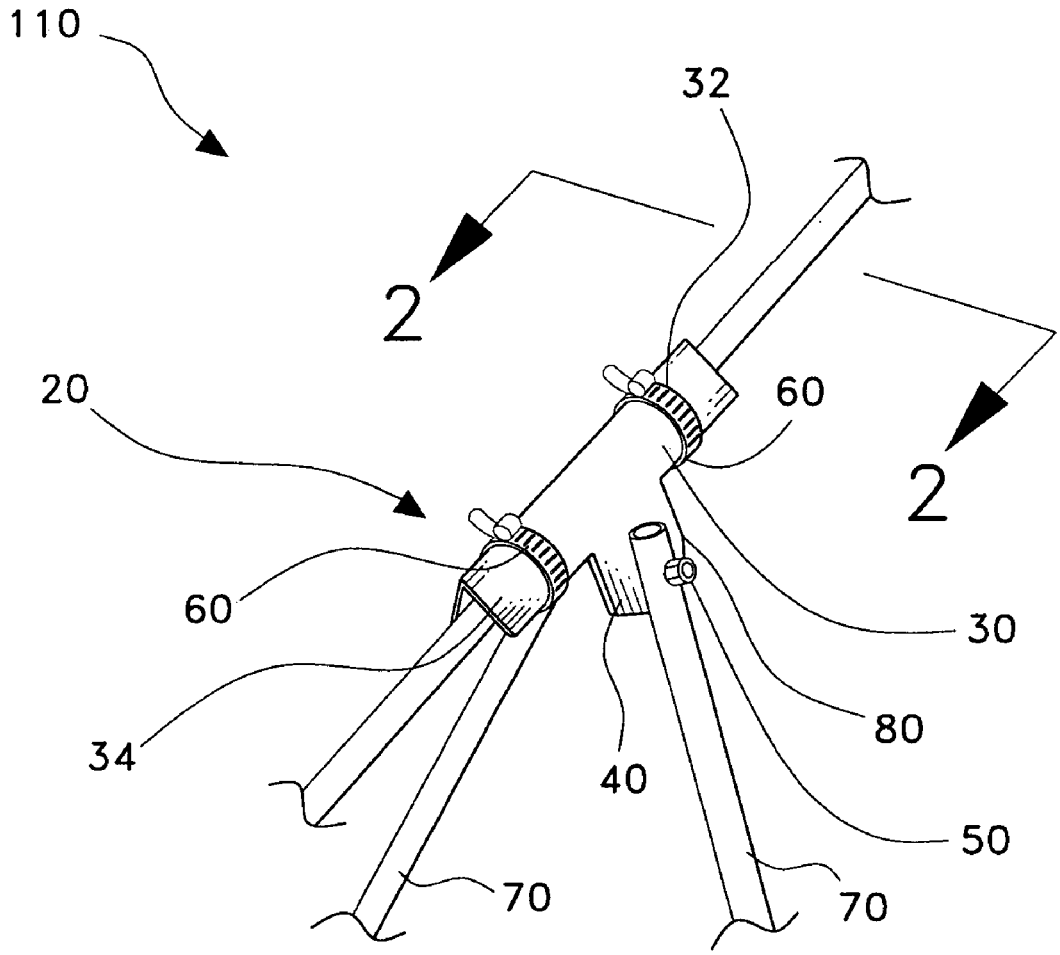
Figure 2:
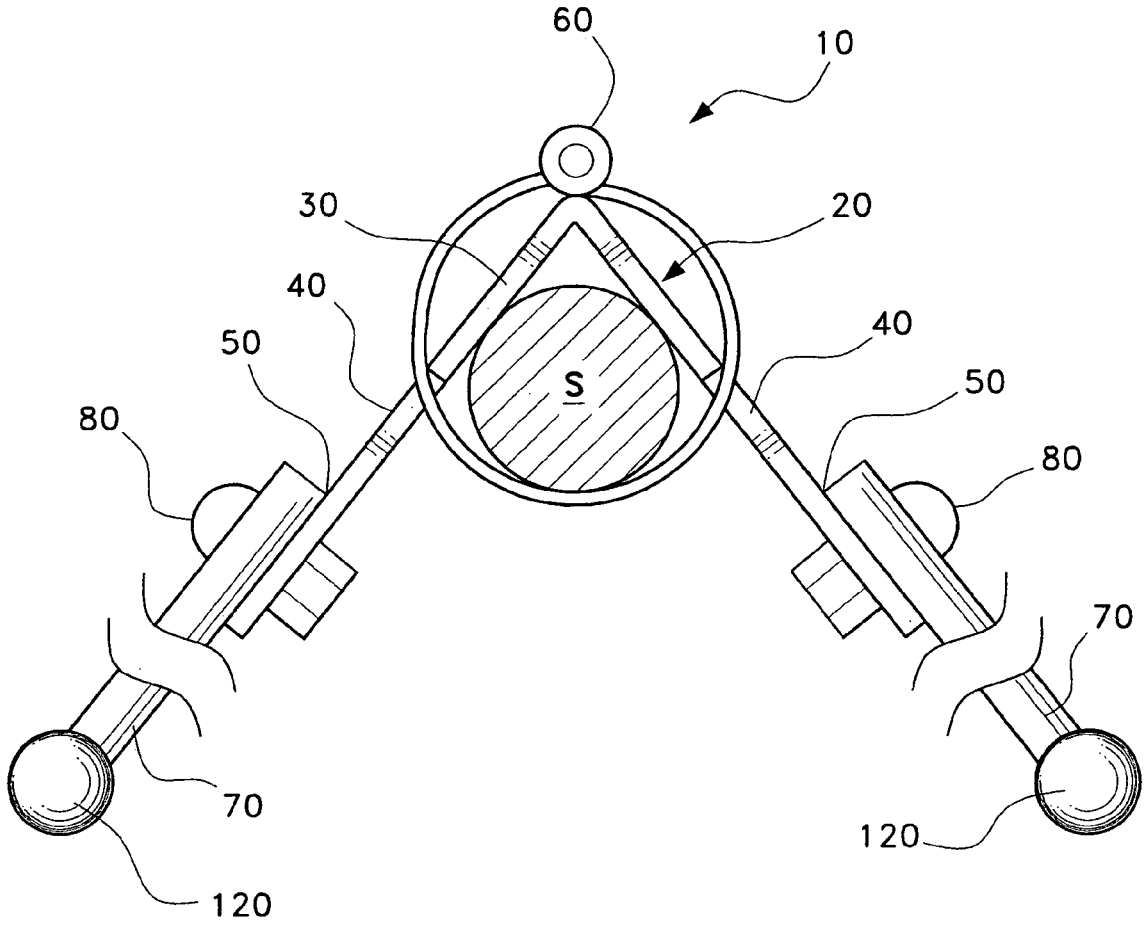
FIG. 2 is a cross-sectional perspective view of the golf club and golf pin stand along line 2—2 of FIG. 1A and FIG. 1B.

The present invention is a golf club and golf pin stand 10, as is shown in FIG. 1A and FIG. 1B.

The golf club and golf pin stand 10 comprises a main body support bracket 20 adapted to connect to a shaft S of a golf pin GP, the main body support bracket 20 having an elongated section 30 with two central wings 40, a top end 32 and a bottom end 34. Each central wing 40 has an aperture 50 thereon. There is also a hose clamp 60 being disposed on the top end 32 of the elongated section 30 and the bottom end 34 of the elongated section 30. These hose clamps 60 hold the shaft S of the golf pin GP along the elongated section 30 and between the two central wings 40.

The golf club and golf pin stand 10 further comprises a leg member 70 being pivotally attached to each central wing 40 with a rivet 80 disposed at each aperture 50 connecting the leg member 70 to the central wing 40. The leg members 70 pivot freely relative to the main body support bracket 20 between a retracted position and an extended position. The leg members 70 are substantially parallel to each other in the retracted position and the leg members 70 are angularly separated in the extended position.

Figure 3:
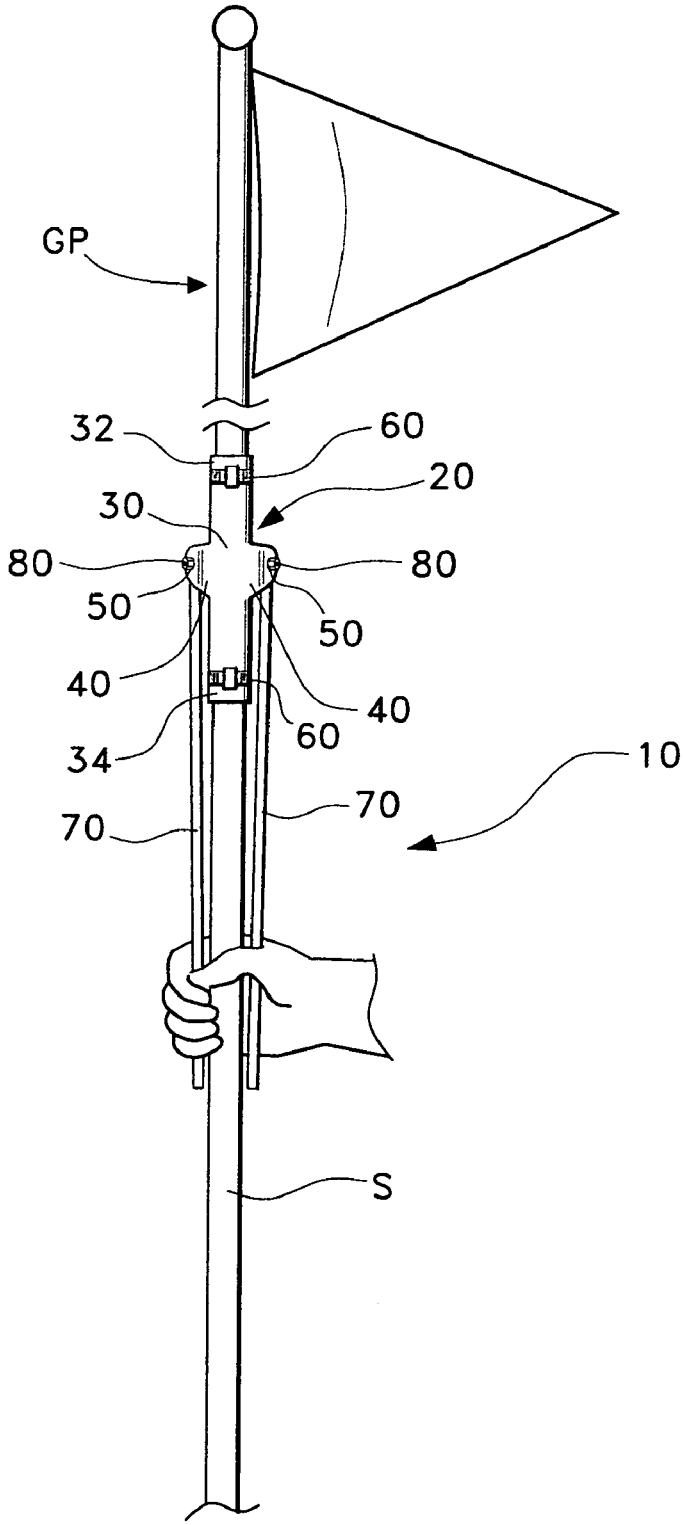
FIG. 3 is a front perspective view of the golf club and golf pin stand in a retracted position on a golf pin.

The main body support bracket 20 can also be adapted to support a golf club or golf clubs when the leg members 70 are in the extended position. The leg members 70 pivot freely relative to the main body support bracket 20 in an extended position perpendicular to the shaft S of the golf pin GP and when the golf pin GP is in a horizontal position and a retracted position. As is shown in FIG. 3, the leg members 70 can also be parallel to the shaft S of the golf pin GP, when the golf pin GP is in a vertical position and a retracted position. Each leg member 70 also has a plastic cap 120 adapted for engagement with a soft ground surface, such as a putting green, to minimize potential damage to the ground surface.

The golf club and golf pin stand 10 further comprises a first chain 90 and a second chain 100. Both the first chain 90 and the second chain 100 have a pair of ends 92,94,102,104 with each of the leg members 70 being attached to one of the ends 92,94 of the first chain 90. One of the ends 102,104 of the second chain 100 is also being attached to the first chain 90, and one of the ends 102,104 of second chain 100 is also attached to the shaft S of the golf pin GP with a removable clasp 106. The first chain 90 and the second chain 100 help to form a tripod between the leg members 70 and the golf pin GP that can also be used as an upright support to lean golf clubs (not shown) against and place other golfing accessories (such as a towel) onto. The golf club and golf pin stand 10 keeps the golf club handles (not shown) high enough above the ground to keep the handles clean and dry.

It should be noted that the golf club and golf pin stand 10 may be an integral part of a golf pin GP to form a golf pin assembly 110. The main body support bracket 20 of the golf club and golf pin stand 10 can also be permanently attached, for example by welding, to a golf pin GP at the time of manufacture. The preferred embodiment, however, is intended to be a retrofit device using the golf club and golf pin stand 10 and an existing golf pin GP.

Use of the golf club and golf pin stand 10 is straightforward. Both leg members 70 are telescopic and can be easily manipulated and retracted manually. The golf club and golf pin stand 10 uses two hose clamps 60 that can secure the main body support bracket 20 to the shaft S of a golf pin GP with the use of an ordinary screwdriver. The leg members 70 are riveted to the main body support bracket 20, but can also utilize nuts and bolts (not shown) to attach the leg members 70 to the main body support bracket 20. Although designed to retrofit already existing golf pins GP, the golf club and golf pin stand 10 can be combined with a golf pin GP to form a permanent golf pin assembly 110.

The main body support bracket 20 is made of aluminum and is approximately 3" long. ½" hose clamps 60 are also used as well as leg members 70 that are approximately 20" long when fully extended. The leg members 70 and central wings 40 form an approximate 70° angle with each other and the caps 120 that are on each end of the leg members 70 are made of a soft plastic material.

It is to be understood that the present invention is not limited to the embodiment described above, but encompasses any and all embodiments within the scope of the following claims.

We claim:

1. A golf club and golf pin stand, comprising:

a main body support bracket adapted to connect to a shaft of a golf pin, said main support bracket having an elongated section with two central wings and a top end and a bottom end, each central wing having an aperture thereon;

a hose clamp being disposed on the top end of the elongated section and the bottom end of the elongated section, said hose clamps holding the shaft of the golf pin along the elongated section and between the two central wings;

a leg member being pivotally attached to each central wing with a rivet disposed at each aperture connecting the leg member to the central wing;

wherein said leg members pivot freely relative to said main body support bracket between a retracted position and an extended position, said leg members are substantially parallel to each other in the retracted position, said leg members are angularly separated in the extended position, and said main body support bracket is adapted to support a golf club when said leg members are in the extended position.

2. The golf club and golf pin stand according to claim 1, further comprising a first and a second chain, each chain having a pair of ends, each of said leg members being attached to one of said ends of said first chain, one of said ends of said second chain being attached to said first chain, and one of said ends of second chain being attached to said shaft of the golf pin.

3. A golf pin assembly, comprising in combination:

a golf pin having a shaft, said shaft having a vertical position and a horizontal position;

a main body support bracket adapted to connect to the shaft of the golf pin, said main support bracket having an elongated section with two central wings and a top end and a bottom end, each central wing having an aperture thereon;

a hose clamp being disposed on the top end of the elongated section and the bottom end of the elongated section, said hose clamps holding the shaft of the golf pin along the elongated section and between the two central wings;

a leg member being pivotally attached to each central wing with a rivet disposed at each aperture connecting the leg member to the central wing;

wherein said leg members pivot freely relative to said main body support bracket between a retracted position and an extended position, said leg members are substantially parallel to each other in the retracted position, said leg members are angularly separated in the extended position, and said main body support bracket is adapted to support a golf club when said leg members are in the extended position.

4. The golf pin assembly according to claim 3, further comprising a first and a second chain, each chain having a pair of ends, each of said leg members being attached to one of said ends of said first chain, one of said ends of said second chain being attached to said first chain, and one of said ends of second chain being attached to said shaft of the golf pin.

* * * * *